US011026464B2

(12) United States Patent
Axelsson et al.

(10) Patent No.: US 11,026,464 B2
(45) Date of Patent: Jun. 8, 2021

(54) STRAP RETAINER FOR ATTACHING A CHINSTRAP TO A SAFETY HELMET

(71) Applicant: 3M INNOVATIVE PROPERTIES COMPANY, St. Paul, MN (US)

(72) Inventors: Peter L. Axelsson, Borlange (SE); Christina E. S. Wester, Hedemora (SE); Pernilla M. Nolåkers, Falun (SE)

(73) Assignee: 3M Innovative Properties Company, St. Paul, MN (US)

( * ) Notice: Subject to any disclaimer, the term of this patent is extended or adjusted under 35 U.S.C. 154(b) by 80 days.

(21) Appl. No.: 16/607,125

(22) PCT Filed: May 8, 2018

(86) PCT No.: PCT/IB2018/053196
§ 371 (c)(1),
(2) Date: Oct. 22, 2019

(87) PCT Pub. No.: WO2018/207097
PCT Pub. Date: Nov. 15, 2018

(65) Prior Publication Data

US 2020/0128901 A1 Apr. 30, 2020

(30) Foreign Application Priority Data

May 12, 2017 (EP) ..... 17170747

(51) Int. Cl.
*A42B 3/08* (2006.01)

(52) U.S. Cl.
CPC ..... *A42B 3/08* (2013.01)

(58) Field of Classification Search
CPC ..... A42B 3/08; F41H 1/08; A01K 27/005; A44B 11/2592; A44B 11/266; Y10T 24/50
See application file for complete search history.

(56) References Cited

U.S. PATENT DOCUMENTS 4,569,106 A * 2/1986 Lovato ..... A44B 11/266 24/615
5,203,058 A * 4/1993 Krauss ..... A44B 11/266 24/587.12

(Continued)

FOREIGN PATENT DOCUMENTS

| | | |
|---|---|---|
| DE | 102015008761 | 11/2016 |
| EP | 3165108 | 5/2017 |
| WO | WO 2014-046973 | 3/2014 |

OTHER PUBLICATIONS

International Search Report for PCT International Application No. PCT/IB2018/053196, dated Jun. 22, 2018, 5 pages.

(Continued)

*Primary Examiner* — Tajash D Patel
(74) *Attorney, Agent, or Firm* — Sandra K. Nowak

(57) ABSTRACT

A strap retainer (4) for attaching a chinstrap (3) to a safety helmet (1). The strap retainer (4) includes a clip (5) that has a first latch (52A) that is movable between an engaged position and a retracted position. The first latch (52A) is resiliently biased toward the engaged position. The strap retainer (4) further has a slider (6) that is displaceable between a lock setting and a release setting. The lock setting causes a movement of the first latch (52A) toward the retracted position to be impeded, and the release setting causes the impeding to be suspended.

11 Claims, 5 Drawing Sheets

(56) References Cited

U.S. PATENT DOCUMENTS

| | | | | |
|---|---|---|---|---|
| 5,279,505 | A * | 1/1994 | Goudreau | G08B 21/22 24/579.09 |
| 6,622,350 | B2 * | 9/2003 | Austin | A44B 11/2592 24/312 |
| 8,353,066 | B2 * | 1/2013 | Rogers | A42B 3/14 2/421 |
| 10,485,282 | B2 | 11/2019 | Coursimault | |
| 2006/0123607 | A1 * | 6/2006 | Howell | A44B 11/263 24/615 |
| 2006/0272136 | A1 | 12/2006 | Chui | |
| 2011/0072547 | A1 * | 3/2011 | Doria | F41H 1/08 2/2.5 |
| 2011/0107565 | A1 | 5/2011 | Shen | |
| 2013/0333634 | A1 * | 12/2013 | Rosenquist | A44B 11/263 119/865 |
| 2015/0059066 | A1 * | 3/2015 | Ketterer | A42B 3/14 2/418 |
| 2015/0351500 | A1 * | 12/2015 | Kolasa | A44B 11/2592 24/615 |
| 2017/0245578 | A1 * | 8/2017 | Xiong | A42B 3/147 |

OTHER PUBLICATIONS

Extended EP Search Report for EP Application No. 17170747.4, dated Nov. 29, 2017, 9 pages.

* cited by examiner

STRAP RETAINER FOR ATTACHING A CHINSTRAP TO A SAFETY HELMET

CROSS REFERENCE TO RELATED APPLICATIONS

This application is a national stage filing under 35 U.S.C. 371 of PCT/IB2018/053196, filed May 8, 2018, which claims the benefit of European Application No. 17170747.4 filed May 12, 2017, the disclosure of which is incorporated by reference in its/their entirety herein.

FIELD OF THE INVENTION

The invention relates to a strap retainer for attaching a chinstrap to a safety helmet and to a system comprising a safety helmet and a head retention system having a strap retainer for attaching the chinstrap to the safety helmet.

BACKGROUND ART

Safety helmets are typically used as head protection in different areas, like for example in constructions work zones. Various government agencies and industry organizations define certain requirements and standards for protective gear, including helmets and respirators. In the United States, for example, the National Institute of Occupational Safety and Health (NIOSH) certifies certain safety equipment for the workplace and the American National Standards Institute (ANSI) recommends voluntary consensus industry standards. There are further European Standards related to safety helmets, like for example EN 397. Other agencies and organizations around the world also establish safety standards for helmets and respirators. For safety helmets, some of these standards relate to impact energy attenuation, penetration resistance, force transmission, stiffness, flammability, and head coverage.

To meet these safety requirements and standards, safety helmets usually comprise a rigid outer protective shell of metal or plastic and a suspension system inside the shell. The suspension system serves many purposes, including providing a proper fit of the helmet to the wearer's head, holding the inner part of the helmet away from the wearer's head, distributing the weight of the helmet over a larger area of the wearer's head, and attenuating the force transferred to the wearer's head upon impact of an object with the outer helmet shell. Suspension systems often comprise a headband attached to a crown support assembly which includes crisscrossing crown straps and a crown pad. In some applications, however, additional protection may be desired.

For some applications or workplaces an additional chinstrap is desired or required. The chinstrap typically retains the safety helmet more securely on the wearer's head, in particular as the helmet is exposed to forces in a direction away from the wearer's head as they may occur for example during a fall of the wearer or during overhead work. Depending on the area or application in which the safety helmet is used, different requirements for the attachment of a chinstrap may apply. For example, while in a work environment the chinstrap may be required to automatically detach from the helmet if exposed to high forces, automatic detachment may not be desired or permitted in other areas or applications.

SUMMARY OF THE INVENTION

The invention relates to a strap retainer for attaching a chinstrap to a safety helmet. The strap retainer may generally comprise a clip that has a first latch that is movable between an engage position and a retracted position. The first latch may be resiliently biased toward the engage position. Further, the clip may have a second latch that is movable between an engage position and a retracted position. The second latch may be resiliently biased toward the engage position too. The clip may have a first retention leg having a first free end. Preferably the first latch protrudes laterally from the first retention leg adjacent the first free end. The clip may have a second retention leg having a second free end. Preferably the second latch protrudes laterally from the second retention leg adjacent the first free end.

The strap retainer in particular comprises a clip that has a base from which a first and a second retention leg protrude. The first retention leg has a first free end and the second retention leg has a second free end. A first latch protrudes from the first retention leg. The first latch is arranged adjacent the first free end. A second latch protrudes from the second retention leg. The second latch is arranged adjacent the second free end. The first and second retention leg are arranged in a mirrored relationship with each other about a mirror axis. The mirrored relationship is such that the first and second latch protrude away from each other, in particular in opposite directions. The first and second retention leg provide movability of the first and second latch between an engage position and a retracted position. The first latch and the second latch each being resiliently biased toward the engage position, in particular via the first and second retention leg, respectively. The strap retainer further has a slider that is displaceable between a lock setting and a release setting. The lock setting causes a movement of the first latch and the second latch toward the retracted position to be impeded. Further the release setting causes the impeding to be suspended. The first latch forms a first retention surface and the second latch forms a second retention surface. The first and second retention surface are parallel to each other and face in a direction toward the base.

The invention is advantageous in that it provides a head retention system that comprises a chinstrap, which can be adjusted between a first mode (release setting) and a second mode (lock setting). In the first mode the head retention system automatically releases from the safety helmet upon a first force limit is exceeded in a pulling force between the head retention system and the safety helmet. In the second mode the head retention system may automatically release from the safety helmet upon a second (greater) force limit is exceeded in a pulling force between the head retention system and the safety helmet. Alternatively, in the second mode the head retention system is prevented from releasing from the safety helmet.

The first and second retention surface are preferably arranged in a common plane with each other. Further, the first and second retention surface may be arranged perpendicular to the mirror axis. For example the first and second retention surface form may form a right angle with the first and second retention leg. The movement of the first and second latch at least in the engaged position is preferably restricted to a dimension within the plane of the first and/or second retention surface. For example if the movement is curved, the initial movement in the engaged position is along a dimension within the plane of the first and/or second retention surface although the further movement continues toward an area in which the first and/or second retention surface faces.

The release setting preferably causes the strap retainer to be detachably connectable to a safety helmet, whereas the lock setting preferably causes the strap retainer to be fixedly connectable to the same safety helmet. Thus, the strap retainer allows the connection of the strap retainer in two different ways so that the same chinstrap can be used for different applications. It is noted that the fixed connection may detach in consequence of a part of the strap retainer and/or the safety helmet breaking or damaging. Accordingly a detachment of the fixed connection is a destructive detachment, whereas the detachable connection refers to a nondestructive connection.

In particular, the first and the second retention leg may protrude generally parallel to each other. The clip preferably has an insertion axis. The insertion axis corresponds to the mirror axis. Further the insertion axis corresponds to a dimension along which the strap retainer can be inserted in (or removed from) a receptacle of the safety helmet. The first and second retention leg preferably protrude parallel to the insertion axis.

In one embodiment in the lock setting the slider impedes the movement of the first latch toward the retracted position. Accordingly, the impeding may be caused by the slider in the lock position. The impeding may further be suspended by the slider in the release setting.

In a further embodiment the slider has a first tongue that, in the lock setting of the slider, impedes the movement of the first latch toward the retracted position. In particular, in the lock setting of the slider the first tongue is preferably in the way of the movement of the first latch toward the retracted position.

The first and second latch preferably protrude from the first and second retention leg, respectively, in opposite directions away from each other and laterally or perpendicular to the insertion axis.

In an embodiment the slider is arranged between the first and the second retention leg. In the lock setting the slider is positioned closer toward the first and second free end than in the release setting.

In a further embodiment the slider further has a second tongue. In the lock setting of the slider, the second tongue impedes the movement of the second latch toward the retracted position. In particular, in the lock setting of the slider the second tongue is preferably in the way of the movement of the second latch toward the retracted position. Thus, the in the lock setting the slider preferably impedes or blocks the movement of the first and second latch toward the retracted position. In particular, the in the lock setting the slider preferably impedes or blocks the movement of the first and second free end of the first and second retention leg (that carry the first and second latch, respectively) toward the retracted position. The slider and the clip are preferably displaceably guided, preferably guided for a linear movement along the insertion axis, relative to each other. One of the clip and the slider may comprise an elongated hole and the other one of the clip and the slider may comprise a sliding structure. The sliding structure may be received within the elongated hole.

Further, the slider and the clip may be attached to each other. Thus, the slider and the clip are movable between the lock and the release setting but fixed with each other otherwise.

The slider preferably comprises a grip portion. The grip portion facilitates moving the slider between the release and the lock setting.

In an embodiment the strap retainer comprises a ratchet means for snap-retaining the slider in the lock setting and, alternatively, in the release setting. This prevents inadvertent resetting of the slider from any of the lock and the release setting.

In a further embodiment the clip has an eyelet for attaching the chinstrap to the clip.

In a further aspect the invention relates to a system that comprises a safety helmet and a head retention system. The head retention system comprises a chinstrap and, preferably attached to it, at least one strap retainer. The head retention system may comprise a chinstrap and attached to it two or three strap retainers.

The strap retainer preferably comprises a clip that has a first latch that is movable between an engage position and a retracted position. The first latch may be resiliently biased toward the engage position.

The strap retainer in particular comprises a clip that has a base from which a first and a second retention leg protrude. The first retention leg has a first free end and the second retention leg has a second free end. A first latch protrudes from the first retention leg. The first latch is arranged adjacent the first free end. A second latch protrudes from the second retention leg. The second latch is arranged adjacent the second free end. The first and second retention leg are arranged in a mirrored relationship with each other about a mirror axis. The mirrored relationship is such that the first and second latch protrude away from each other, in particular in opposite directions. The first and second retention leg provide movability of the first and second latch between an engage position and a retracted position. The first latch and the second latch each being resiliently biased toward the engage position, in particular via the first and second retention leg, respectively. The strap retainer further has a slider that is displaceable between a lock setting and a release setting. The lock setting causes a movement of the first latch and the second latch toward the retracted position to be impeded. Further the release setting causes the impeding to be suspended. The first latch forms a first retention surface and the second latch forms a second retention surface. The first and second retention surface are parallel to each other and face in a direction toward the base.

The strap retainer may have further features as disclosed herein and in the dependent claims.

The safety helmet comprises a receptacle for connecting the strap retainer. The receptacle comprises a first rest for engaging with the first latch of the strap retainer. Further, the receptacle may comprise a second rest for engaging with the second latch of the strap retainer. In a situation in which the strap retainer is mated with the receptacle the first latch positioned in the engage position engages with the first rest. In the situation in which the strap retainer is mated with the receptacle further the second latch positioned in the engage position may engage with the second rest.

In one embodiment the strap retainer forms a plug means and the receptacle forms a socket means. Accordingly, the strap retainer can be retained at the safety helmet by plugging in the socket.

In an embodiment the strap retainer in the release setting allows a nondestructive detachment of the strap retainer and the receptacle upon being urged away from each other at a force that exceeds a pre-determined force limit. The nondestructive detachment of the strap retainer is achieved by virtue of the parallel arrangement of the first and second retention surface. In particular the movement of the first and second latch from the engage position toward the retracted position is not impeded by a form fit with the first and second rest, respectively. (But a form fit between the latches and the corresponding rests retains the strap retainer and the receptacle along the insertion axis.) Rather, the movement of the first and second latch from the engage position toward the retracted position is enabled because of only a friction fit—see also FIG. 3 that illustrates this principle). This differs from prior art snap connections in which engaged hooks prevent a corresponding movement. Further, the strap retainer in the release setting provides the connection to be maintained below that force limit. The nondestructive detachment of the strap retainer and the receptacle means particularly that the detachment is reversible. For example, neither the strap retainer nor the receptacle are destroyed. Therefore, after a nondestructive detachment the strap retainer and the receptacle can be reconnected.

In an embodiment the force limit in the release setting of the slider corresponds to an effective force that occurs between the strap retainer and the receptacle in response to a tensile force between the chinstrap and the helmet within a range of 150 N to 250 N. In that regard it is noted that the chinstrap may be attached to the helmet at two or more points so that the effective force is a partial force of the tensile force. For example for a two-point retention system in which the chinstrap is attached on opposite sides of the helmet the effective force at one of the two points would be 50% of the tensile force. The test method for determining the tensile force in the release setting of the slider is described in the Standard (Svensk Standard) SS-EN 397:2012, approved 2012 Feb. 8, published 2012 Feb. 14, Edition 2 (for example under section 6.9).

The strap retainer in the lock setting preferably prevents a detachment of the strap retainer and the receptacle upon being urged away from each other. In the lock setting of the slider the force limit to be exceeded until the strap retainer detaches from the safety helmet is higher than the force limit in the release setting of the slider. In particular, in the lock setting of the slider a detachment of the strap retainer and the receptacle is typically destructive. Hence, one or both of the strap retainer and the receptacle would break to enable detachment.

The force limit in the lock setting of the slider also corresponds to an effective force that occurs between the strap retainer and the receptacle in response to a tensile force between the chinstrap and the helmet.

In one embodiment the tensile force in the lock setting of the slider is greater than 500 N. The test method for determining the tensile force in the lock setting of the slider is described in the Standard (Svensk Standard) SS-EN 12492:2012, approved 2012 Feb. 13, published 2012 Feb. 17, Edition 2 (for example under section 5.7).

DETAILED DESCRIPTION OF THE INVENTION

Figure 1:
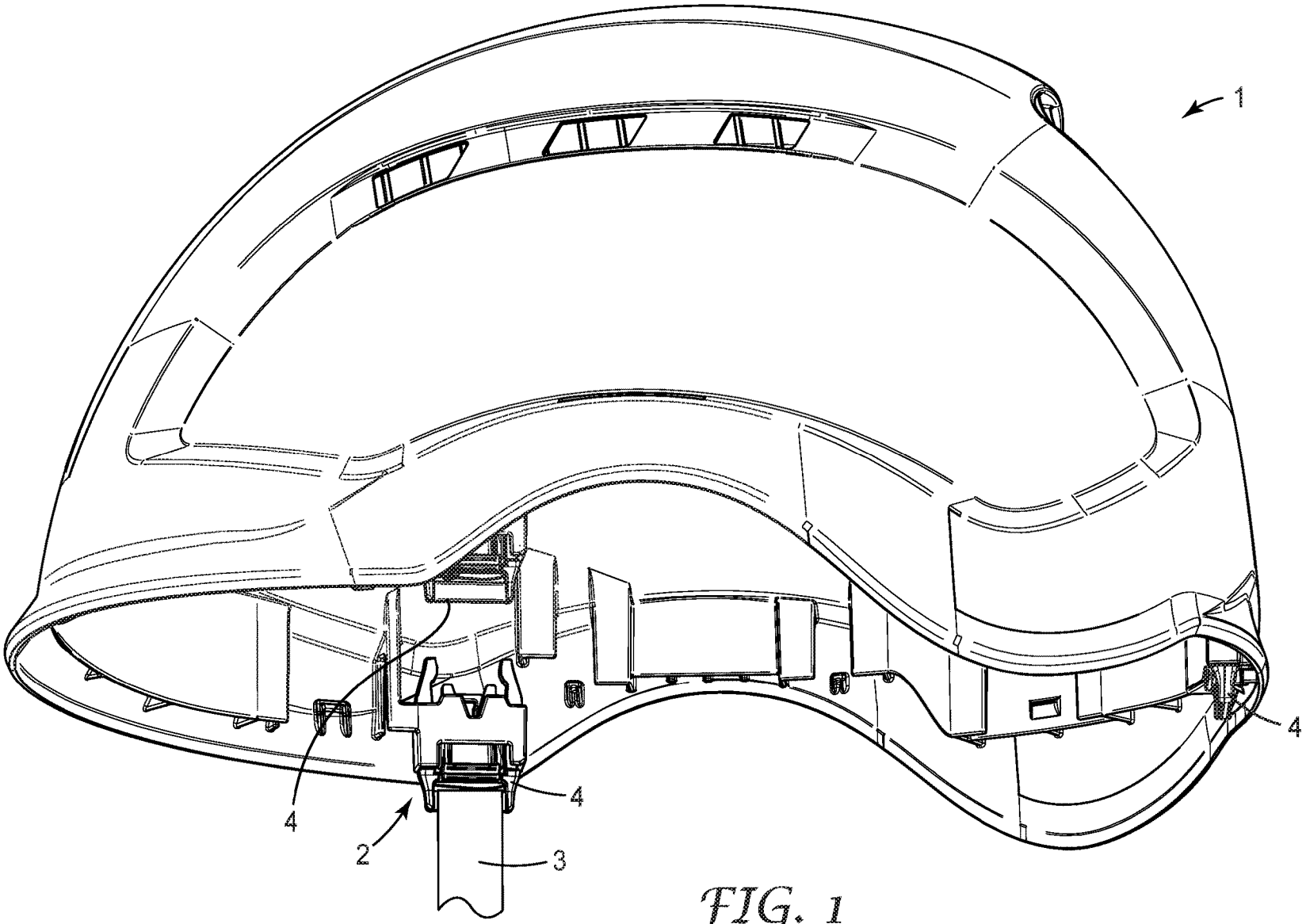
FIG. 1 is a perspective view of a system according to an embodiment of the invention.

FIG. 1 shows a system that comprises a safety helmet 1 and a head retention system 2. The head retention system 2 has a chinstrap 3 (only partially indicated) that is attached to the safety helmet 1 via a strap retainer 4 according to the invention. The head retention system 2 is particularly attached on opposite sides of the safety helmet via two strap retainers 4. Further, in the example, the head retention system 2 is a so-called three-point head retention system in which the chinstrap is additionally attached via a further strap retainer 4 at a rear side of the safety helmet 1. It is noted that in other examples one end of the chinstrap may be fixedly attached at one side of the safety helmet and the other end of the chinstrap may be attached to the other side of the safety helmet via the strap retainer 4. Further, a two-point head retention system as well as three- or four-point head retention system may be used with the present invention.

Figure 2:
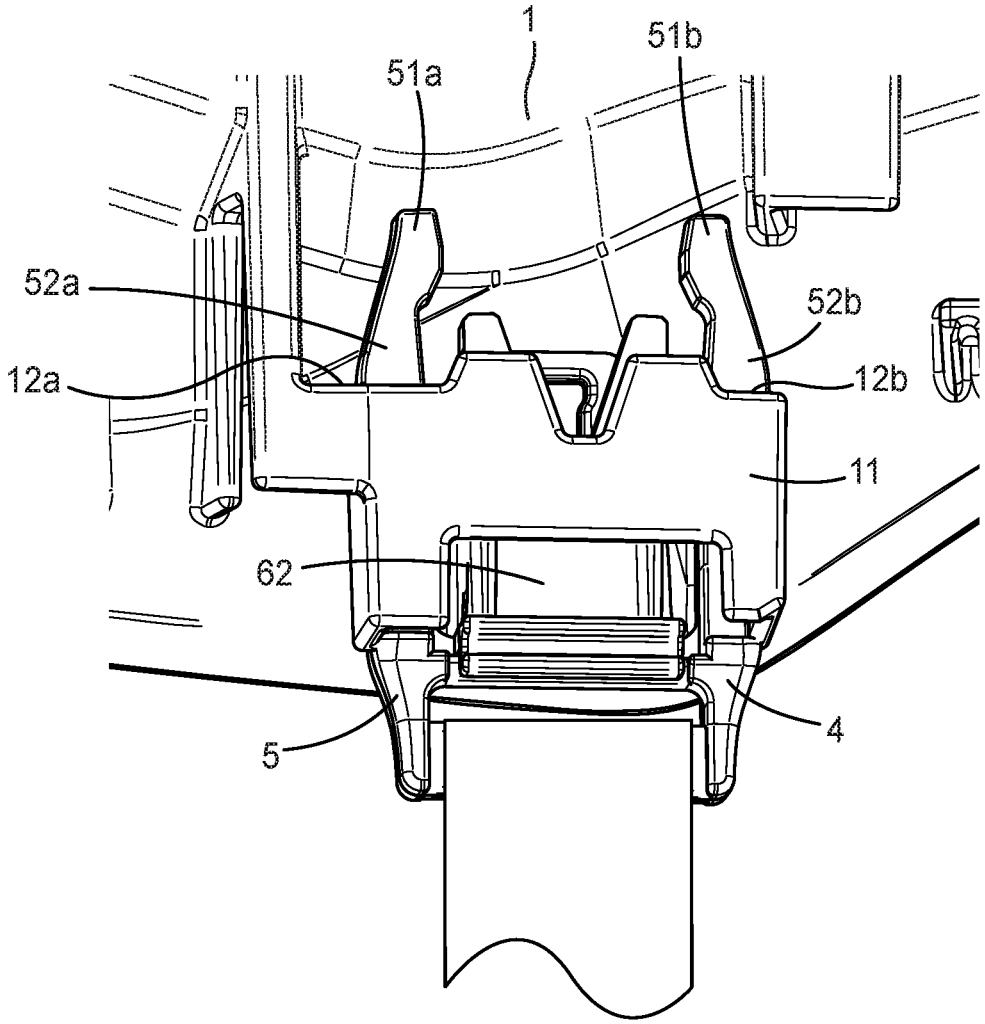
FIG. 2 is a detail view of FIG. 1.

As illustrated in the detail view of FIG. 2 the safety helmet 1 has a receptacle 11 for connecting the strap retainer 4 to the safety helmet 1. In the example the receptacle 11 is formed by a lug that protrudes from the safety helmet 1. In particular, the lug protrudes from the safety helmet 1 inwardly toward a space for a wearer's head formed by the safety helmet 1. The strap retainer 4 is received within the lug and retained therein by a snap connection. The strap retainer 4 particularly has a clip 5 that forms a first retention leg 51*a* and a second retention leg 51*b*. Each of the first and second retention leg 51*a*, 51*b* have a first and a second latch 52*a*, 52*b*, respectively (see also FIG. 3). The first and second retention leg 51*a*, 51*b* extend parallel (or essentially parallel). Further, the first and second retention leg 51*a*, 51*b* are resilient, in particular bendable toward each other.

In the situation shown the first and second retention leg 51*a*, 51*b* extend through the lug so that the first and second latch 52*a*, 52*b* are snapped behind the lug and thus retain the strap retainer 4 at the safety helmet 1. In this example the lug has a U-shaped structure (like a bridge) for clasping around the first and second retention leg 51*a*, 52*b*. Further, the lateral sides of the U-shaped structure (the bridge pillar) form a first and a second rest 12*a*, 12*b* that engage with the first and second latch 52*a*, 52*b*, respectively.

It is noted that the receptacle may be formed by another structure than the lug. For example, the receptacle may comprise two opposite L shaped protrusions instead of the U-shaped lug, or a socket. Basically any structure that is configured for receiving the first and second retention leg 51*a*, 52 and which provides rests for engaging with the first and second latch 52*a*, 52*b* may be used with the present invention.

Figure 5:
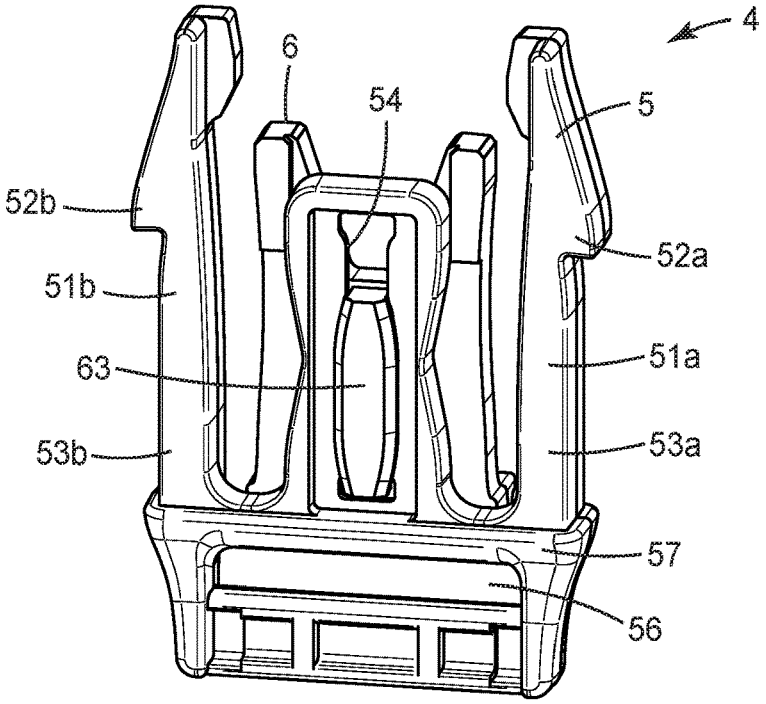
FIG. 5 is a perspective view of a strap retainer in a release setting according to an embodiment of the invention.

FIG. 5 shows the strap retainer 4 of the invention in more detail. As mentioned, the strap retainer 4 has the clip 5 with the first and the second retention leg 51*a*, 51*b*. The first and second retention leg 51*a*, 51*b* protrude from a common base 57 toward a first and second free end of the first and second retention leg 51*a*, 51*b*, respectively. Each of the first and the second retention leg 51*a*, 51*b* has a shaft portion 53*a*, 53*b*, respectively, which in the example extend at a uniform cross-section (but which may have other cross-sections as appropriate). Further, the first and the second retention leg 51*a*, 51*b* have a first and a second latch 52*a*, 52*b*, respectively. The first and the second retention leg 51*a*, 51*b* are resilient. In particular, the material and the cross-section of the first and the second retention leg 51*a*, 51*b* (in particular of the first and second shaft 53*a*, 53*b*) are selected so that the first and the second retention leg 51*a*, 51*b* are bendable between an engage position and a retracted position. The engage position is shown in the Figure and corresponds to a position which the first and the second retention leg 51*a*, 51*b* assumes naturally, meaning when not urged toward a particular direction by any external force acting on the first and second retention leg 51*a*, 51*b*. Further, the retracted position (not shown) corresponds to a position in which the first and/or second retention leg 51*a*, 51*b* is/are moved, for example bent, in a direction opposite of the direction in which the latch protrudes. Thus, the first and the second retention leg 51*a*, 51*b* can bend toward each other while being pushed in the receptacle of the safety helmet. Once the first and second retention leg 51*a*, 51*b* are pushed far enough into the receptacle, the first and second latch 52*a*, 52*b* snap behind the first and second rest of the receptacle and cause the strap retainer to retain with the receptacle.

Figure 4:
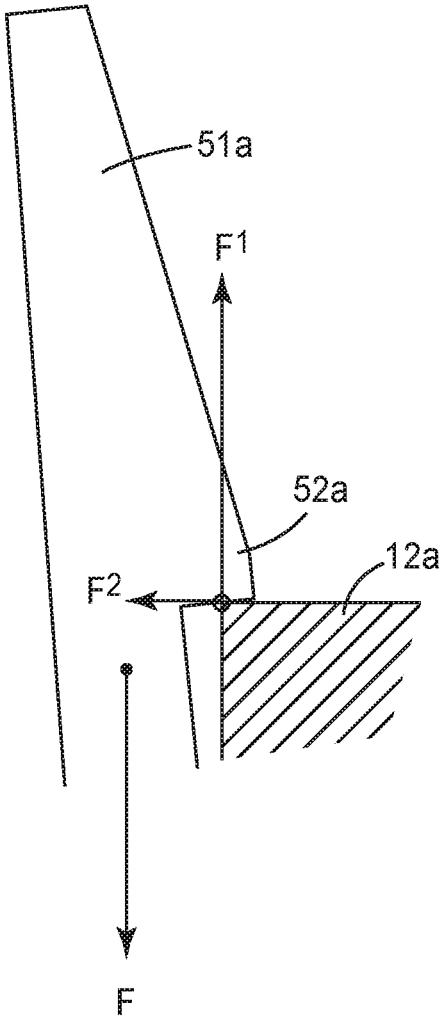

The first and second latch 52*a*, 52*b* protrude laterally from the first and second retention leg 51*a*, 51*b* so that the first and second retention leg 51*a*, 51*b* have a generally L-shaped structure. Although the L-shaped structure of the first and the second retention leg 51*a*, 51*b* provides for a retention when the strap retainer 4 is mated (as shown in FIG. 2) with the receptacle of the safety helmet, such retention provides for a limited retention force only, as illustrated in FIGS. 4 and 5. This means that although a snap connection is provided between the strap retainer and the receptacle that connection can be nondestructively detached if the strap retainer and the receptacle are pulled away from each other at a certain force.

Figure 3:
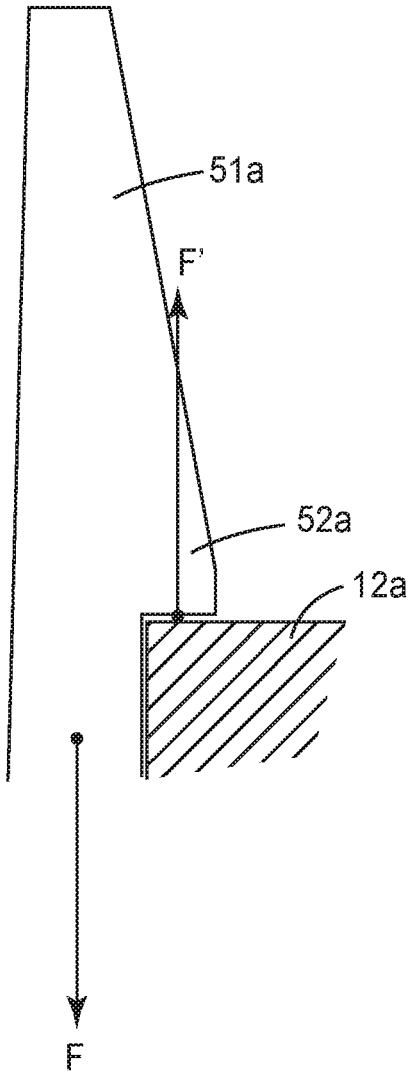
FIGS. 3 and 4 are a schematic views illustrating a function of a retention leg according to an embodiment of the invention.

FIG. 3 shows, as an example, a portion of the first retention leg 51*a* with the first latch 52*a* engaged with the first rest 12*a*. In the situation shown the first retention leg 51*a* is in the engage position. A force F is applied to the first retention leg 51*a*. Such a force typically results from the chinstrap pulling at the strap retainer, for example, in case the safety helmet is pulled in a direction away from a wearer's head. Further, as a reaction of the force F, a force F' is generated via the first rest 12*a* to the first latch 52*a*. As illustrated, the forces F and the resulting force F' are parallel offset. Accordingly, a force momentum arises within the first retention leg 51*a* which causes the first retention leg 51*a* to bend away from the first rest 12*a* as illustrated in FIG. 4. As illustrated an inclination of the first latch 52*a* relative to the first rest 12*a* causes an additional lateral force F2 which additionally urges the first retention leg 51*a* away from the first rest 12*a* until the first latch 52*a* disengages from the first rest 12*a*. The same action typically occurs generally simultaneously at the first and the second retention leg so that upon pulling the strap retainer away from the receptacle of the safety helmet the strap retainer will automatically and nondestructively detach from the receptacle upon exceeding a particular force limit during the pulling action. It is noted that the principle outlined in FIGS. 3 and 4 is simplified and may in reality be more complex or differ in detail or with different embodiments. It has however been found that the strap retainer, depending on the selected dimensions and the material of the first and second retention leg, reproducibly detaches at exceeding a particular force limit when pulled away from the receptacle. This is used to provide the retaining system with a self-detaching function upon a certain force limit is exceeded.

Returning to FIG. 5 the strap retainer 4 further has a slider 6 which in the illustrated example is positioned in a release setting. This means that the slider 6 allows the first and second retention leg 51*a*, 52*b* to move between the engage and the retracted position. In particular in the release setting the slider 6 does not hinder the first and second retention leg 51*a*, 51*b* in moving between the engage position and the retracted position.

Figure 6:
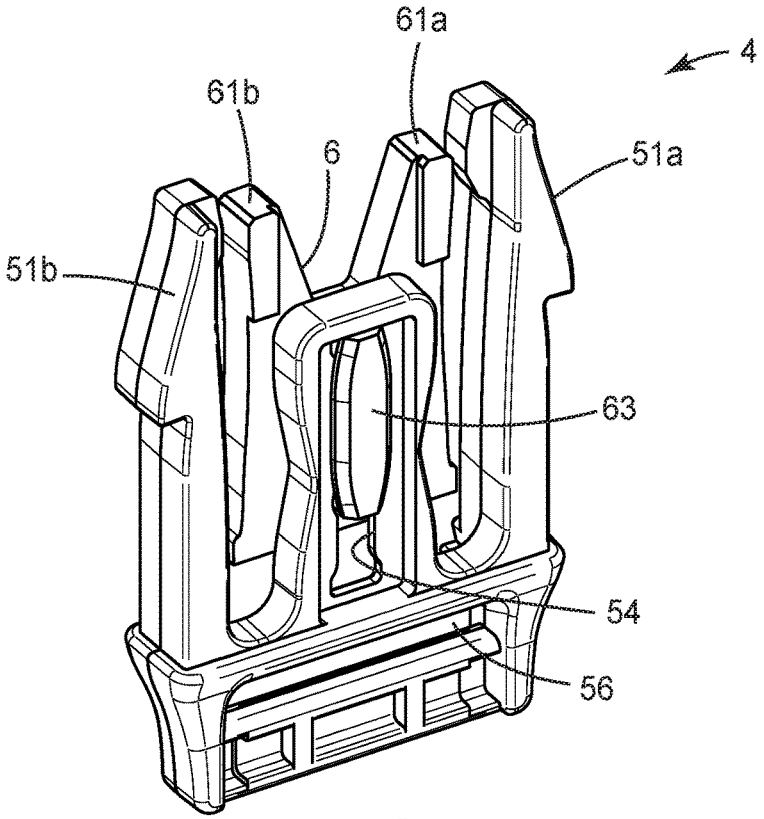
FIG. 6 is a perspective view of the strap retainer of FIG. 5 in a lock setting.

In FIG. 6 the slider 6 is positioned in a lock setting. In the lock setting the slider 6 impedes or prevents a movement of the first and second retention leg 51*a*, 51*b* toward the retracted position. This means that the above mentioned self-detaching function is prevented or impeded in the lock setting of the slider 6. In the example the slider 6 has a first and a second tongue 61*a*, 61*b* which prevent a movement of the first and second retention leg 51*a*, 51*b*, respectively. This means that in the lock setting of the slider 6 the force limit to be exceeded until the strap retainer detaches from the safety helmet is higher than the force limit in the release setting of the slider 6. In particular, in the lock setting of the slider the strap retainer and the receptacle may only detach in consequence of one or both of the strap retainer and the receptacle being destroyed or break. Accordingly, in the lock setting of the slider 6 the detachment of the strap retainer and the receptacle is preferably disabled or enabled only by a destructive detachment.

Figure 7:
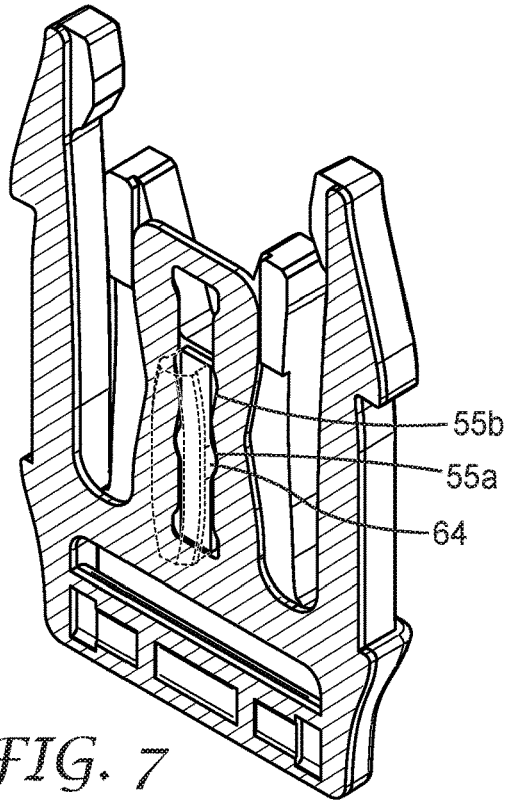
FIG. 7 is a perspective detail view of FIG. 5.

The strap retainer 4, in particular the clip 5, further has an elongated hole 54 for guiding a sliding structure 63 of the slider 6 therein. The elongated hole 54 and the sliding structure 63 are configured to permit a restricted a movement of the slider 6 relative to the clip 5 between the release and the lock setting, and to restrict any movement between the slider 6 and the clip 5 laterally thereto. The sliding structure 63 is snap fit within the elongated hole 54. Thus, the slider 6 and the clip 5 remain assembled during handling. Further (as shown in a detail view provided in FIG. 7), the elongated hole 54 has recesses 55*a*, 55*b* for cooperating with a bulge 64 at the slider 6. The bulge 64 snaps into recess 55*a* in the release setting of the slider and snaps into recess 55*b* in the lock setting of the slider 6. Thus, the slider 6 is retained in either of the release setting and the lock setting. Accordingly, inadvertent resetting of the slider in an undesired setting can be prevented.

Further, the strap retainer has an eyelet 56 for attaching a chinstrap thereto. It is noted that other means for attaching the chinstrap are possible, for example a clamp, welded or bonded connection.

Figure 8:
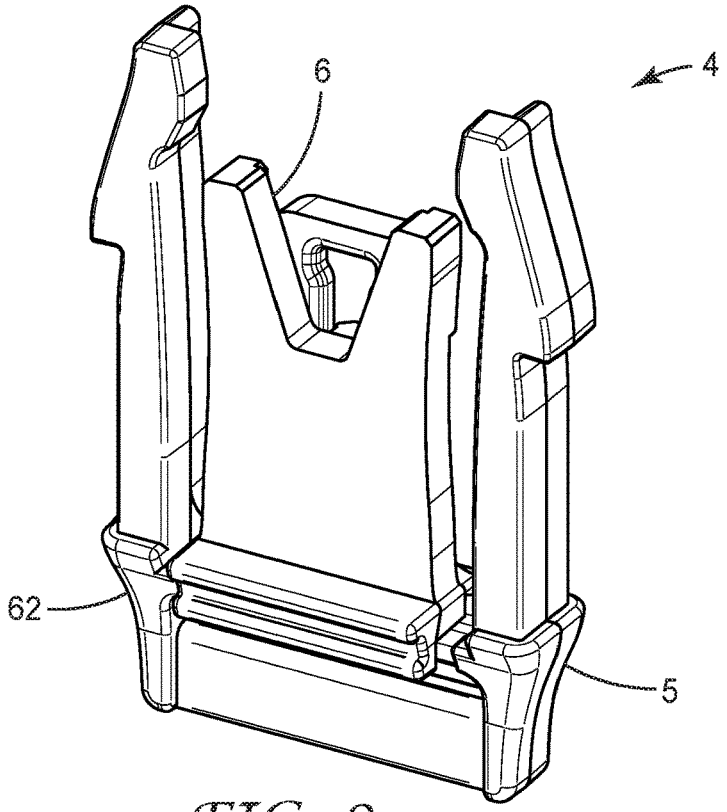
FIG. 8 is a perspective view of a strap retainer according to an embodiment of the invention.

As shown in FIG. 8 the slider 6 may have or form a marker 62 that, when the strap retainer 4 is mated with the receptacle (shown in FIG. 2), is visible in the release setting and hidden (for example by the receptacle) in the lock setting. Thus, a wearer of the helmet can easily recognize whether the head retention system is attached at the helmet so that it detaches at low or high forces or whether the head retention system is attached at the helmet so that it can detach or cannot detach.

The invention claimed is:

1. A strap retainer for attaching a chinstrap to a safety helmet, the strap retainer comprising a clip that has a base from which a first and a second retention leg protrude, the first retention leg having a first free end and the second retention leg having a second free end, a first latch protrudes from the first retention leg adjacent the first free end and a second latch protrudes from the second retention leg adjacent the second free end, wherein the first and second retention leg are arranged in a mirrored relationship with each other about a mirror axis such that the first and second latch protrude away from each other, the first and second retention leg provide movability of the first and second latch between an engage position and a retracted position, the first latch and the second latch each being resiliently biased toward the engage position, wherein the strap retainer further having a slider that is displaceable between a lock setting and a release setting, wherein the lock setting causes a movement of the first latch and the second latch toward the retracted position to be impeded, and wherein the release setting causes the impeding to be suspended, wherein the first latch forms a first retention surface and the second latch forms a second retention surface, and wherein the first and second retention surface are parallel to each other and face in a direction toward the base.

2. The strap retainer of claim 1, wherein the first and second retention surface are arranged perpendicular to the mirror axis.

3. The strap retainer of claim 1, wherein in the lock setting the slider impedes the movement of the first latch toward the retracted position.

4. The strap retainer of claim 1, wherein the slider has a first and second tongue that, in the lock setting of the slider, impede the movement of the first and second latch, respectively, toward the retracted position.

5. The strap retainer of claim 4, wherein the slider is arranged between the first and the second retention leg.

6. The strap retainer of claim 4, wherein in the lock setting the slider is positioned closer toward the first and second free end than in the release setting.

7. The strap retainer of claim 1, comprising a ratchet means for snap-retaining the slider in the lock setting and, alternatively, in the release setting.

8. The strap retainer of claim 1, wherein the clip has an eyelet for attaching the chinstrap to the clip.

9. A system comprising a safety helmet and a head retention system, the head retention system comprising a chinstrap and at least one strap retainer according claim 1, wherein the safety helmet comprises a receptacle for connecting the strap retainer, the receptacle comprising a first rest for engaging with the first latch of the strap retainer, wherein in a situation in which the strap retainer is mated with the receptacle the first latch positioned in the engage position engages with the first rest.

10. The system of claim 9, wherein the strap retainer, by virtue of the parallel arrangement of the first and second retention surface, in the release setting allows a nondestructive detachment of the strap retainer and the receptacle upon being urged away from each other at a force that exceeds a pre-determined force limit.

11. The system of claim 10, wherein the force limit corresponds to an effective force that occurs between the strap retainer and the receptacle in response to a tensile force between the chinstrap and the helmet within a range of 150 N to 250 N.

* * * * *